US006732889B2

(12) United States Patent
Oren et al.

(10) Patent No.: US 6,732,889 B2
(45) Date of Patent: May 11, 2004

(54) POURING SPOUT FOR LIQUID CONTAINERS, AND LIQUID CONTAINERS CONSTRUCTED THEREWITH

(76) Inventors: Ishai Oren, 16A Even Shaprot, 92478 Jerusalem (IL); Yoav Tikochinsky, 12 Engel Street, 65224 Tel Aviv (IL); Eran Zur, Rehov Bialik, 63324 Tel Aviv (IL)

( * ) Notice: Subject to any disclaimer, the term of this patent is extended or adjusted under 35 U.S.C. 154(b) by 8 days.

(21) Appl. No.: 10/066,746

(22) Filed: Feb. 6, 2002

(65) Prior Publication Data

US 2003/0146247 A1 Aug. 7, 2003

(51) Int. Cl.[7] ..... B65D 5/72
(52) U.S. Cl. ..... 222/494
(58) Field of Search ..... 222/494, 83, 189.09, 222/386.5, 215, 212

(56) References Cited

U.S. PATENT DOCUMENTS 3,506,163 A * 4/1970 Rauh et al. ..... 222/212
4,520,948 A 6/1985 Hampel et al.
4,674,532 A 6/1987 Koyanagi
4,696,415 A * 9/1987 Meshberg ..... 222/207
4,765,512 A 8/1988 Bull, Jr.
4,917,646 A 4/1990 Kieves
5,183,184 A 2/1993 Ranalletta et al.
5,996,845 A * 12/1999 Chan ..... 222/212
6,079,594 A * 6/2000 Brown et al. ..... 222/494

* cited by examiner

*Primary Examiner*—Philippe Derakshani
(74) *Attorney, Agent, or Firm*—G. E. Ehrlich (1995) Ltd.

(57) ABSTRACT

A pouring spout for a liquid container, the pouring spout including a pliable plastic sheet defining one side of the pouring spout and freely movable towards and away from an opposite side of the pouring spout to close and open the pouring spout for dispensing liquid therethrough. The pliable plastic sheet is dimensioned such that when liquid is not being dispensed from the pouring spout, the pliable plastic sheet moves towards and into contact with the opposite surface and adheres thereto by surface tension to produce a self-sealing action with respect to the pouring spout.

24 Claims, 10 Drawing Sheets

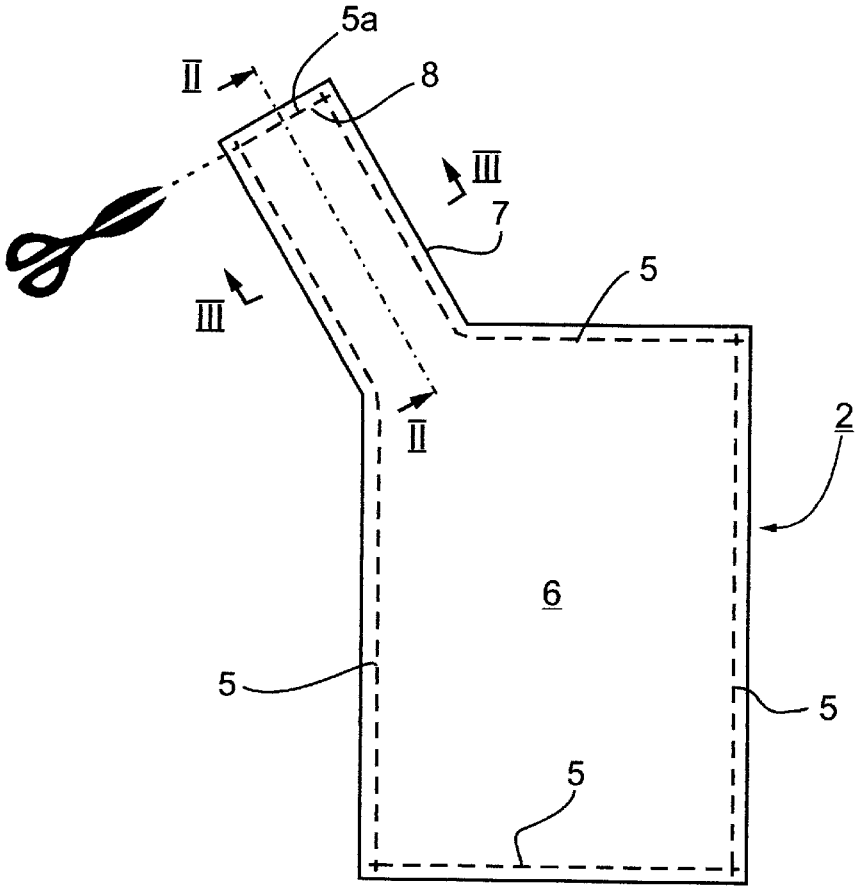
Fig. 1
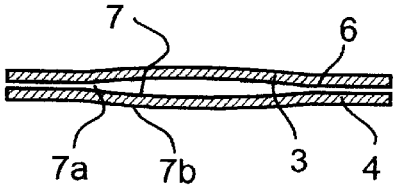
Fig. 2
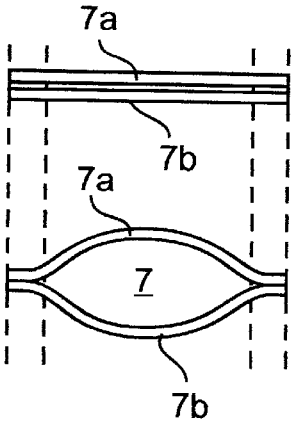
Fig. 3
Fig. 4
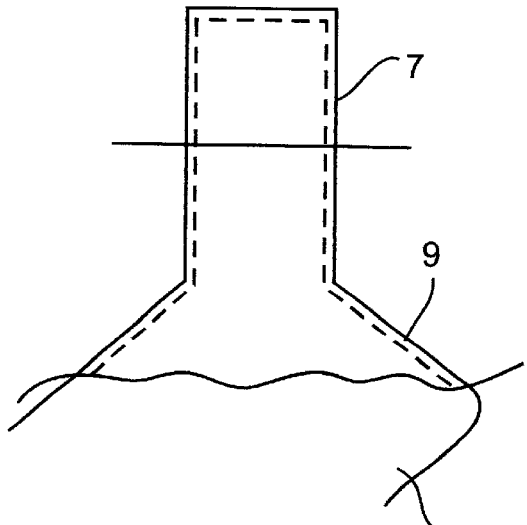
Fig. 5

POURING SPOUT FOR LIQUID CONTAINERS, AND LIQUID CONTAINERS CONSTRUCTED THEREWITH

FIELD AND BACKGROUND OF THE INVENTION

The present invention relates to novel pouring spouts for liquid containers, and also to liquid containers constructed with the novel pouring spout.

Drinkable liquids are typically distributed in containers of variety of designs and shapes, including bottles, laminated cartons and sealed plastic sleeves. Some liquids, such as milk natural juices, wine and many other beverages are distributed in sterile containers, in order to prolong their shelf life. To this end, milk and other beverage containers are treated under high temperature in processes known as pasteurization and Ultra High Temperature (UHT) treatment. Wines are inherently sterile as they typically contain about 14 or more % alcohol in volume, at which concentration of alcohol no life is maintainable.

Liquid containers are provided with a wide variety of pouring spout constructions to enable the liquid contents of the container to be dispensed.

There is a major shared limitation to all existing pouring spouts, as they are all designed and constructed so as to allow air to enter the container upon pouring. Air contains oxygen and typically carries air-born living matter of both prokaryote and eukaryote origin, such as spores and/or mature forms of bacteria, yeast and fungi. Due to this reason, the contact of air with many drinkable liquids, all of which contain organic compounds, results in accelerated spoilage of the liquids. For example, once contaminated with air born living matter, milk spoils within several hours to a few days, depending on the storage temperature. For example, once exposed to oxygen, wine spoils and loses its fine taste.

One popular type of liquid container, commonly used for milk and natural (e.g., orange) juice products, is in the form of a laminated carton integrally formed at its upper end with a gable which may be manually opened by pulling apart its opposite sides to produce a pouring spout. The pouring spout is readily closable by manually returning the opposite sides to their initial condition. The design of this pouring spout permits air to enter to the container upon pouring of the liquid contained therein, thereby significantly decreasing the shelf life of the container contents after once being opened and used. Furthermore, the design of this pouring spout, when re-closed after use, is imperfect and still permits air to enter, thereby further significantly decreasing the shelf life of the container contents after once being opened.

Other containers have more recently been provided with a plastic, tubular pouring spout joined to the gable and normally closed by a screwable cap. However, such a construction not only adds to the costs of producing the containers, but also requires the user to manually remove the cap to permit pouring out the liquid, and to manually reapply the cap in order to reclose the container. Caps sometimes are misplaced when removed. In addition, also this design allows air to enter the container upon pouring the liquid therefrom, resulting in accelerated spoilage of the liquid contents.

Still other containers have recently been provided with a pouring spout including a hinged plastic element, used to open and close the container. This design of a pouring spout, similarly to all of the other designs described herein, allows air to enter the container upon pouring the liquid therefrom, resulting in accelerated spoilage of the liquid contents.

There is thus a widely recognized need for, and it would be highly advantageous to have, a pouring spout and a container devoid of the above limitations. In particular, there is a widely recognized need for, and it would be highly advantageous to have, a pouring spout and a container including same which restrict air from entering the container during or following pouring liquid therefrom, which spout and container can be used for successive pourings, yet the contents thereof is prevented from contacting ambient air and hence prevented from accelerated spoilage.

BRIEF SUMMARY OF THE PRESENT INVENTION

A broad object of the present invention is to provide a pouring spout of a construction which is self-opening when liquid is to be dispensed, and which is self-sealing when liquid is not being dispensed.

Another object of the invention is to provide a pouring spout which can be constructed either as a cap to be applied to an existing container, or as an integral part of the container itself.

A further object of the invention is to provide pouring spouts, and containers including such pouring spouts, of a relatively simple construction which can be produced in volume and at low cost.

Still a further object of the invention is to provide pouring spouts, and containers including such pouring spouts which restrict air from entering the container during or following pouring liquid therefrom through the pouring spout.

Yet a further object of the invention is to provide pouring spouts, and containers including such pouring spouts, which spouts and containers can be used for successive pourings, yet the container's contents is prevented from contacting ambient air, thereby accelerated spoilage is prevented.

Hence, according to one aspect of the present invention, there is provided a pouring spout for a liquid container, the pouring spout comprising a pliable plastic sheet defining one side of the pouring spout and movable towards and away from an opposite side of the pouring spout to close and open the pouring spout for dispensing liquid therethrough; the pliable plastic sheet being dimensioned such that when liquid is to be dispensed, the pliable plastic sheet is freely movable away from the opposite side by the liquid to permit the liquid to be dispensed therethrough, and when liquid is not being dispensed through the pouring spout, the pliable plastic sheet moves towards and into contact with the opposite side and adheres thereto by surface tension to produce a self-sealing action with respect to the pouring spout.

As will be described more particularly below, such a self-sealing pouring spout may be applied to various types of products normally refrigerated to prolong their life after the containers have been opened. In addition, such a pouring spout may also be used to prolong the storage life of non-refrigerated products after opening.

A number of embodiments of the invention are described below for purposes of example. In some described embodiments, the opposite side of the pouring spout is defined by another pliable sheet, whereas in other described embodiments, the opposite side of the pouring spout is a rigid member.

Where the opposite side of the pouring spout is another pliable sheet, the longitudinal edges along the opposite sides of the two pliable sheets should be joined together to define a passageway for dispensing the liquid, but one or both of the longitudinal edges of the two pliable sheets should be free to move to allow the passageway to open when dispensing a liquid, and to be self-closing (and self-sealing) when not dispensing the liquid. If both longitudinal edges are secured, e.g., to an enclosing tube, the pliable sheets should be elastic to allow the opening and self-closing of the dispensing passageway.

On the other hand, when the opposite side of the pouring spout is rigid, it is preferably non-planar, i.e., concave, to allow the self-opening and self-closing of the passageway by the displacement of the pliable sheet toward and away from that rigid surface.

In some described embodiments, the pouring spout is in the form of a cap removably attachable to a liquid container. In other described embodiments, the pouring spout is initially fixed to, or integrally formed with, the liquid container in alignment with an opening therein.

The invention also provides a number of liquid container constructions including such pouring spouts. In one described construction, the liquid compartment of the container is also of pliable plastic sheets which are integrally formed with the pliable plastic sheets of the pouring spout. In other described embodiments, the container is of a rigid construction and includes a filtered air inlet into its liquid compartment to permit dispensing substantially the complete liquid contents of the container through the pouring spout. Still other embodiments are described in which the container is of a construction permitting the internal volume of its liquid compartment to be reduced as liquid is dispensed therefrom.

According to a further described embodiment, the container may also include a manually-movable pressure member for pressing the pliable plastic sheet of the pouring spout to its closed position in contact with the opposite surface. The present invention successfully addresses the shortcomings of the presently known configurations by providing a pouring spout and a container including same which restrict air from entering the container during or following pouring liquid therefrom, which spout and container can be used for successive pourings, yet the contents thereof is prevented from contacting ambient air and hence prevented from accelerated spoilage.

Further features and advantages of the invention will be apparent from the description below.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 illustrates one form of container and pouring spout constructed in accordance with the present invention;

FIG. 2 is a sectional view along line II—II of FIG. 1;

FIG. 3 is a sectional view along line III—III of FIG. 1 in the closed condition of the pouring spout;

FIG. 4 is a sectional view corresponding to that of FIG. 3 but illustrating the open position of the pouring spout;

FIG. 5 is a fragmentary view illustrating a modification in the construction of the container of FIG. 1;

DESCRIPTION OF PREFERRED EMBODIMENTS

Figure 6:
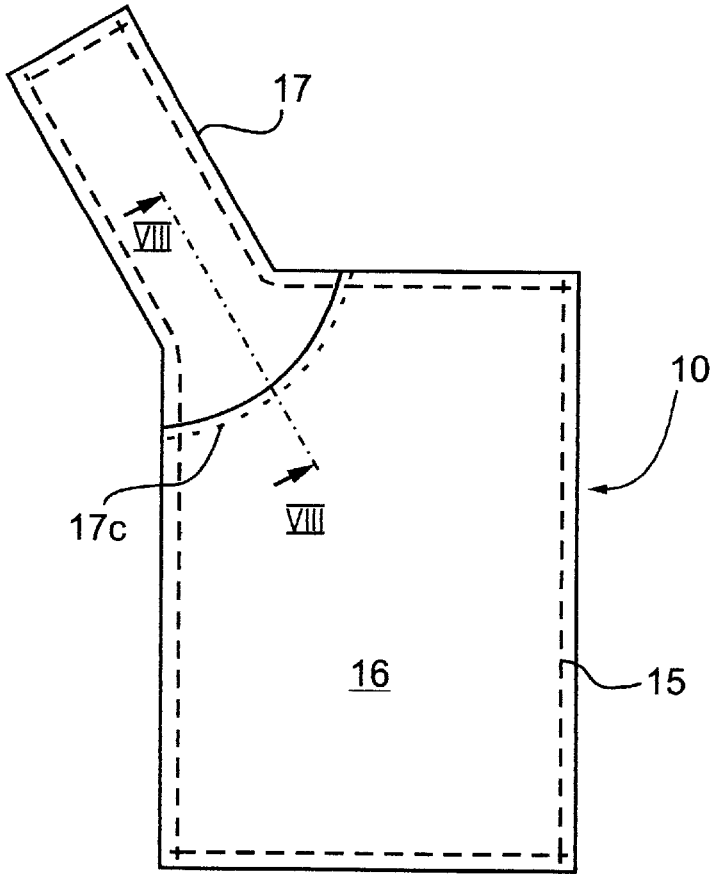
FIG. 6 illustrates another modification in the construction of the container of FIG. 1.

As indicated earlier, the present invention provides a pouring spout for a liquid container which pouring spout is self-opening when liquid is to be dispensed, and self-closing (and generally self-sealing) when liquid is not to be dispensed. The pouring spout of the present invention is specifically designed to prevent air from entering the container in which it is implemented during and following pouring. As such, the pouring spout of the present invention is useful in extending the usage life of liquids which are readily contaminated by air born living matter or oxygen, and which are typically sterilely packaged, following their first use.

Briefly, the novel pouring spout includes at least one pliable plastic sheet defining one side of the pouring spout and movable towards and away from the opposite side of the pouring spout to close and open the pouring spout for dispensing liquid therethrough. The opposite side of the pouring spout may be another pliable plastic sheet, or may be a non-pliable (e.g., rigid) member engageable by the pliable plastic sheet. The constructions described below are such that, when liquid is to be dispensed, the pliable plastic sheet is freely movable away from the opposite side by the liquid to permit the liquid to be dispensed, and when liquid is not being dispensed through the pouring spout, the pliable plastic sheet moves towards and into contact with the opposite side and adheres thereto by surface tension to produce a self-sealing action with respect to the pouring spout.

FIG. 1 illustrates a very simple form of liquid container constructed with a pouring spout in accordance with the present invention. The container illustrated in FIG. 1, and therein generally designated 2, includes two pliable plastic sheets 3, 4 (FIG. 2) cut to the shape illustrated in FIG. 1 and heat-welded around their peripheries, as shown at 5, to define a compartment 6 for the liquid, and a pouring spout 7 for dispensing the liquid from compartment 6. Except for the pouring spout 7, container 2 may be similar to plastic bag containers heretofore used for various liquid products, particularly milk products. Such containers may be held by a holder (not shown) of one of the types widely available to facilitate handling the container and dispensing its contents.

The contents of the container are initially sealed within the container by the peripheral welds 5. The outer end of the pouring spout 7 is also closed by the weld as shown at 5*a*.

When it is desired to dispense contents from the container, the outer end of the pouring spout 7 is severed, along line 8, to thereby open the outer end of the pouring spout. The container may then be tipped to dispense liquid from compartment 6 through the pouring spout 7. The portions of the pliable plastic sheets 3, 4 defining the pouring spout 7, (shown at 7*a* and 7*b* in FIG. 2) are dimensioned both in length and width such that when liquid is to be dispensed, the two sheets are freely movable away from each other, as shown in FIG. 4, to permit the liquid to pass between them; and when liquid is not being dispensed through the pouring spout, the two sheets move back into contact with each other (as shown in FIG. 3) by surface tension, so as to adhere to each other and thereby to produce a self-sealing action.

FIG. 5 illustrates a modification wherein the pouring spout, therein designated 7, is joined to the liquid compartment 6 of the container by a tapered neck or juncture 9 to facilitate dispensing liquid therefrom.

Figure 7:
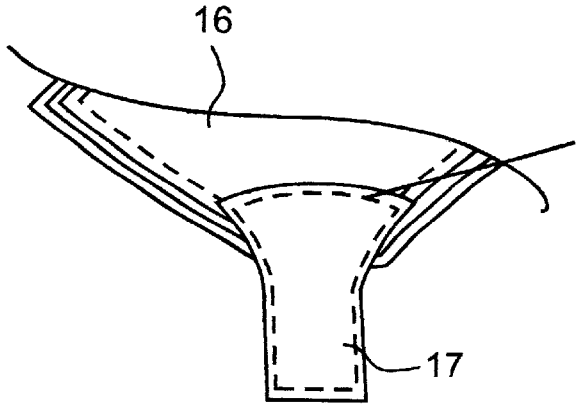
FIG. 7 is a fragmentary view more particularly illustrating the pouring spout construction in the container of FIG. 6.
Figure 8:
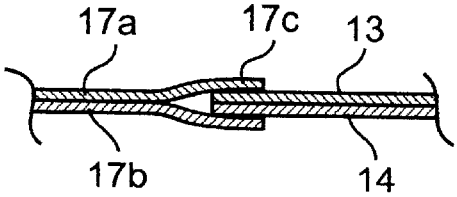
FIG. 8 is a sectional view along line VIII—VIII of FIG. 6.

FIGS. 6–8 illustrate a container 10, similar to that illustrated in FIG. 5, and also constructed of two pliable plastic sheets 13, 14, heat-welded around their peripheries, as shown at 15. In this case, however, the two plastic sheets 13, 14 define only the liquid compartment 16 of the container, whereas two additional plastic sheets, shown at 17*a*, 17*b* (FIG. 8) are heat-welded (at 17*c*) to a corner of the plastic sheets 13, 14 to define the pouring spout 17. In all other respects, the container illustrated in FIGS. 6–8 may be constructed and used as described above with respect to FIG. 5, and also with respect to FIGS. 1–4.

Figure 9:
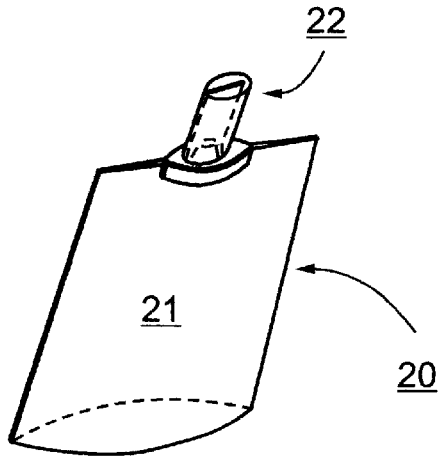
FIG. 9 is illustrates another container including a pouring spout constructed in accordance with the present invention.
Figure 10:
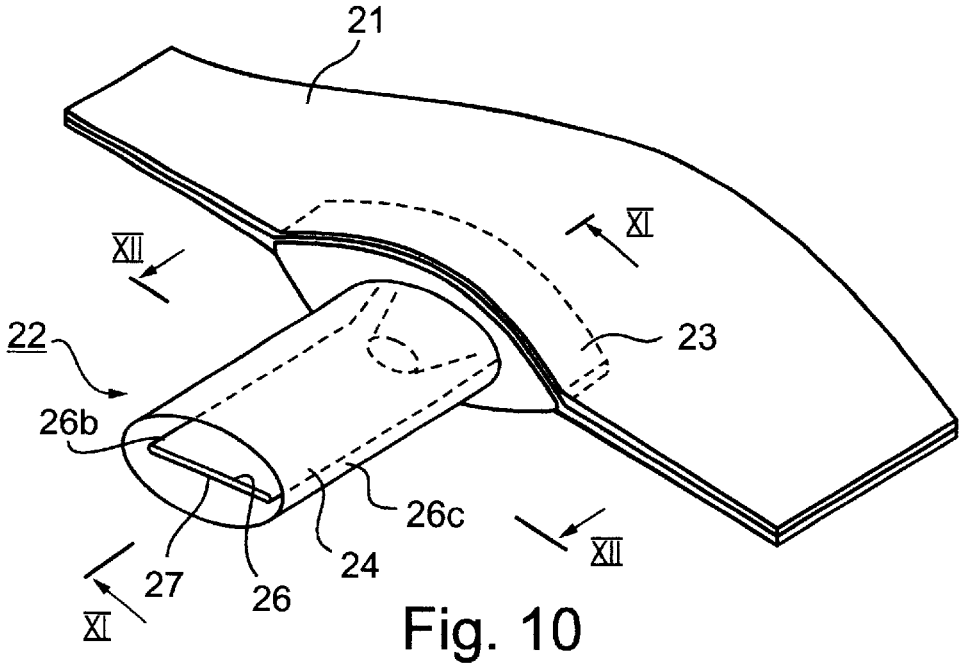
FIG. 10 is an enlarged fragmentary view illustrating the pouring spout in the container of FIG. 9.
Figure 11:
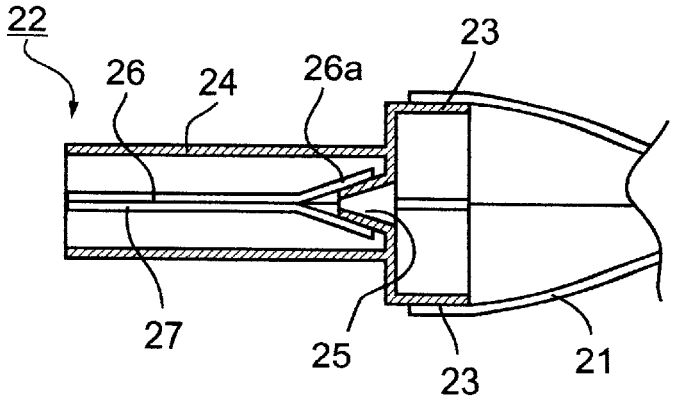
FIG. 11 is a sectional view along line XI—XI of FIG. 10.

FIGS. 9–11 illustrate another container, therein generally designated 20, constructed in accordance with the present invention. Container 20 also includes a liquid compartment section 21 and a pouring spout, generally designated 22, attached to the upper end of the liquid compartment. The liquid compartment 21 may be of any desired construction, such as of plastic sheet material as described above. The pouring spout 22, however, is of a somewhat different construction from that described above.

Thus, as shown in FIGS. 10 and 11, the pouring spout 22 includes a mounting cap 23 fixed, as by heat welding, to the open end of the liquid compartment section 21 of the container 20. Cap 23, which is preferably of a rigid or semi-rigid (stiff) plastic material, is integrally formed with an outer tube 24 and with an inner funnel section 25 communicating with the interior of the tube 24. A pair of pliable plastic sheets 26, 27 are disposed within tube 24 and extend transversely across its interior. Each of the two plastic sheets 26, 27 is bonded at one end to the funnel section 25, as shown at 26*a* in FIG. 11. The two plastic sheets 26, 27 are also bonded along their opposite edges to each other, as shown at 26*b*, 26*c* in FIG. 10. However, the opposite edges of the two plastic sheets are not bonded to the inner side of the tube 24, so as to be freely movable with respect to that tube. Thus, when the container of FIGS. 9–11 is tipped for dispensing its liquid contents, the two longitudinal edges of the plastic sheets 26, 27 are free to move towards each other to produce the dispensing passageway between them, and when the container is returned to its upright position, the dispensing passageway produced by the two sheets 26, 27 is self-closing, and substantially self-sealing, by surface tension as described above.

It will thus be seen that when the two longitudinal edges of the two plastic sheets 26, 27 are not secured to the enclosing tube 24, both of the plastic sheets may be made of pliable plastic material since their longitudinal edges can move towards or away from each other in order to open and close the dispensing passageway. The same applies where one of the longitudinal edges, (e.g., longitudinal edge 26*b*, FIG. 10) is secured to the tube 24. However, if both of the longitudinal edges are secured to the interior of the tube 24, the two pliable sheets 26, 27 should be made of an elastic material to allow them to move apart to open the dispensing passageway, and to move back together to close the dispensing passageway.

Figure 12A:
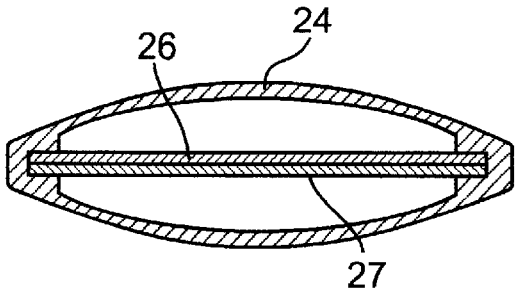
FIG. 12*a* is a sectional view along line XII—XII of FIG. 10, with the pouring spout in its initial, closed condition.
Figure 12B:
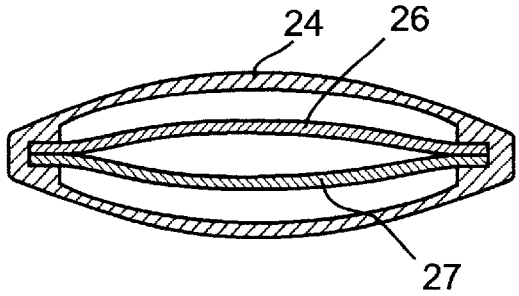
FIG. 12*b* is a view corresponding to that of FIG. 12*a* but showing the pouring spout in its open condition.

The foregoing construction is illustrated in FIGS. 12*a*, 12*b*, wherein both longitudinal edges of the two sheets 26, 27 are secured within the tube 24, and therefore the two sheets should be made of an elastic material in order to permit them to open (as shown in FIG. 12*b*) for dispensing the liquid, and to self-close (and self-seal) when not dispensing a liquid (as shown in FIG. 12*a*).

FIGS. 13*a*–16*a* and 13*b*–16*b* illustrate various modifications that may be provided in the construction of the pouring spout 22 illustrated in FIGS. 9–11. In the illustrated modifications, one side of the dispensing passageway is defined by a pliable sheet (26), but the opposite side is defined by a non-pliable sheet, e.g., by a rigid or stiff surface which is not self-deformable to open and close the dispensing passageway as described above. In this case, the non-deformable side of the dispensing passageway is of a concave configuration to permit the pliable sheet side of the dispensing passageway to move towards or away from the opposite side in order to close and open the dispensing passageway. In the latter constructions the opposite side of the dispensing passageway of concave configuration could be defined by the tube (e.g., 24, FIGS. 10, 11) of the pouring spout.

Figure 13A:
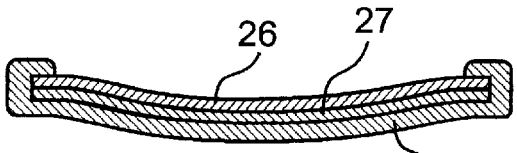
FIGS. 13*a*–16*f* illustrate the closed and open conditions respectively, of several variations in the construction of the pouring spout.
Figure 13B:
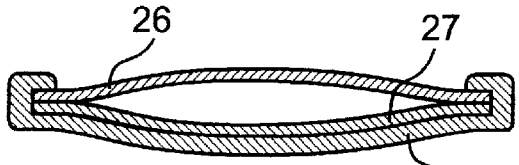

Thus, FIGS. 13*a* and 13*b* illustrate the closed and open conditions of a pouring spout wherein the tubular portion 24 extends only at one side of the two pliable plastic sheets 26, 27 as shown at 24*a*. In this construction, the tubular portion 24*a* is of a concave configuration, and the second pliable sheet 27 is secured to it so as also to assume a concave configuration. Thus, plastic sheet 26 will normally adhere to plastic sheet 27 to close the dispensing passageway (FIG. 13*a*), and will automatically move away from plastic sheet 27 to open the dispensing passageway when liquid is to be dispensed therethrough. The concave configuration of the side of the dispensing passageway defined by two portions 24*a* and plastic sheet 27 adhered thereto permits this self-opening and self-closing of the dispensing passageway.

Figure 14A:
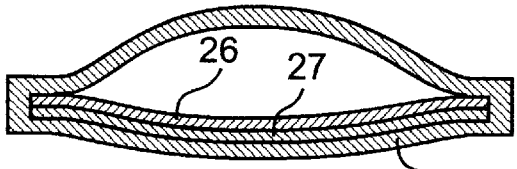
Figure 14B:
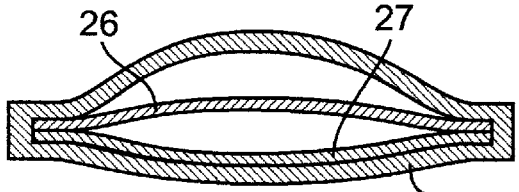
Figure 15A:
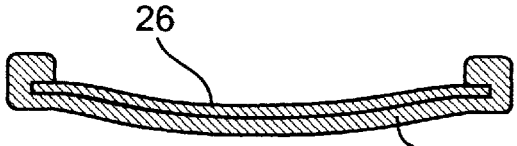
Figure 15B:
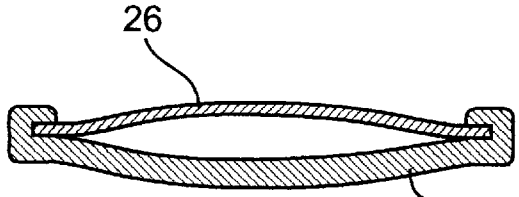
Figure 16A:
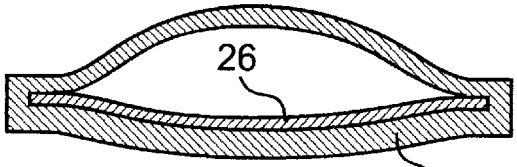
Figure 16B:
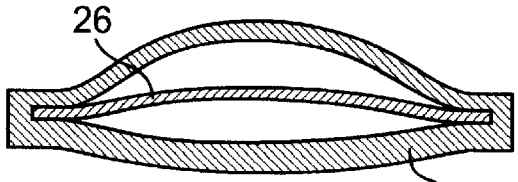

FIGS. 14*a* and 14*b* illustrated the same two conditions in a modification wherein the outer tubular section extends on both sides of the tubular dispensing passageway. As in FIGS. 13*a* and 13*b*, one of the pliable plastic sheets (therein designated 27) is not freely movable but rather is fixed to the inner surface of the tubular section 24, such that the opening and closing of the pouring spout is effected by the movement of the other pliable plastic sheet 26 with respect to the concave surface of plastic sheet 27. FIGS. 15*a* and 15*b* illustrate the same two conditions in a modification wherein the outer tubular section extends only on one side of the pouring spout, as shown at 24*a*, and only one pliable plastic sheet, shown at 26, is movable with respect to it to open and close the pouring spout. FIGS. 16*a* and 16*b* illustrate a modification similar to that of FIGS. 14*a*, 14*b* except that only one pliable plastic sheet, shown at 26, is included, the other pliable plastic sheet (27*a*, FIGS. 14*a*, 14*b*) being omitted.

It will thus be seen that in all the constructions illustrated in FIGS. 13*a*–16*b*, since one side of the dispensing passageway is defined by a concave member, the other side of the dispensing passageway may be defined solely by a pliable sheet (26) even though the opposite longitudinal edges of the pliable sheet are secured against movement.

Figure 16D:
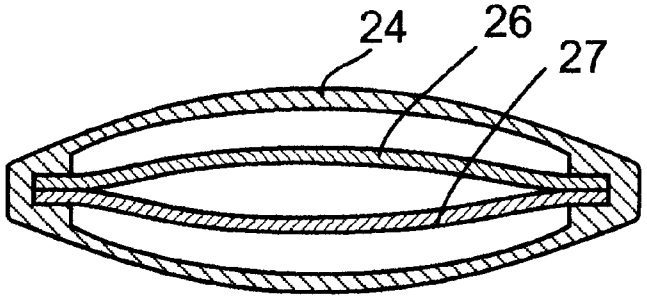
Figure 16C:
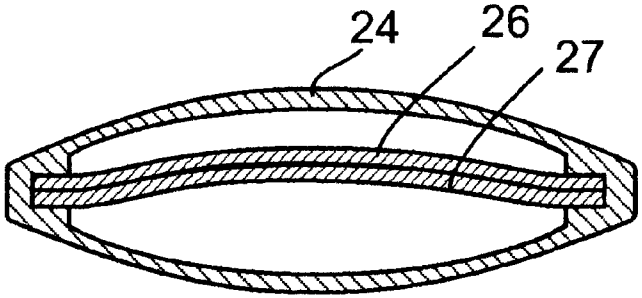
Figure 16F:
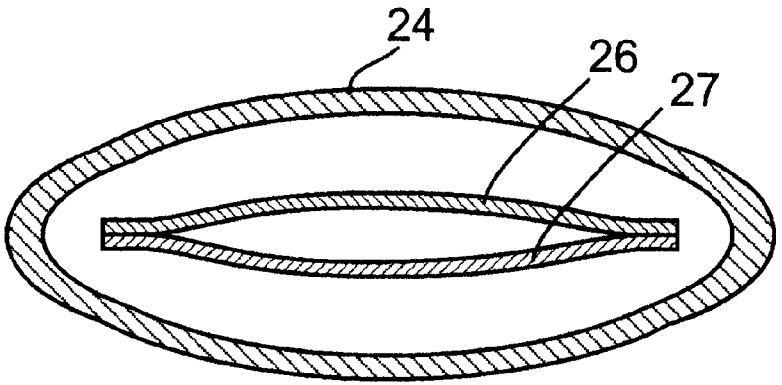

FIGS. 16–16*f* illustrate two further arrangements utilizing pliable non-elastic sheets. Thus, FIGS. 16*c* and 16*d* illustrate a construction similar to that of FIGS. 12*a* and 12*b*, in which the two pliable sheets 26, 27 are secured to an outer tubular section 24, but since the two sheets are curved (e.g., concave) and not straight, they need not be made of an elastic material as in FIGS. 12*a*, 12*b*.

Figure 16E:
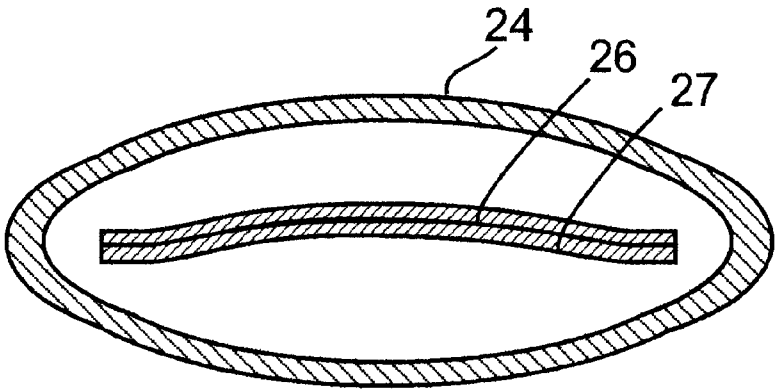

FIGS. 16*e*, 16*f* illustrate a construction similar to that of FIGS. 16*c* and 16*d*, except that the two pliable sheets 26, 27 are not secured at their opposite ends. Therefore, they also need not be made of elastic material since they will open up to permit pouring whether they are curved (as shown) or straight.

Figure 17:
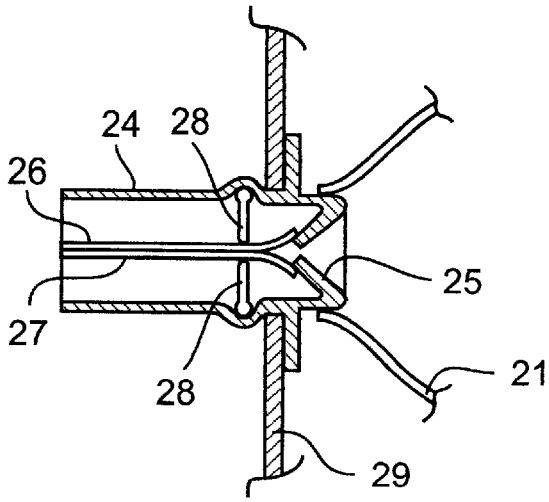
FIG. 17 illustrates another modification in the construction of the pouring spout of FIGS. 9–11.

FIG. 17 illustrates a further construction similar to that of FIGS. 9–11, and therefore similar parts have been correspondingly numbered to facilitate understanding. In the construction of FIG. 17, a deformable elastic membrane 28 is introduced between the outer tube 24 and the two pliable plastic sheets 26, 27, tending to urge them together. Thus, membrane 28 is deformable when liquid is being dispensed between the two plastic sheets, but better assures a self-sealing action by the two sheets when liquid is not being dispensed. Preferably, the two pliable plastic sheets 26, 27, are joined to each other at their longitudinal edges, but should not be joined to the enclosing tube 24 so as to permit opening and closing of the dispensing passageway in the manner described above. If, however, both of the longitudinal edges are to be secured to the enclosing tube 24, the pliable sheets 26, 27 should be made of an elastic material, as described above with respect to FIGS. 12*a*, 12*b*.

Figure 18:
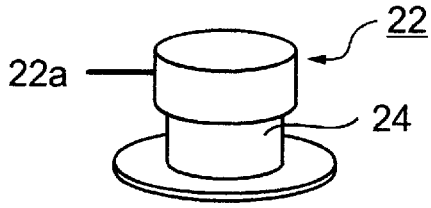
FIG. 18 illustrates the provision of a cap to positively close the pouring spout.

FIG. 18 illustrates a construction wherein the pouring spout 22 is provided with a cap 22*a*, which may be applied by a press-fit or screw-fit over the outer end of tube 24, to better assure a positive closure of the pouring spout when no liquid is being dispensed.

Figure 19:
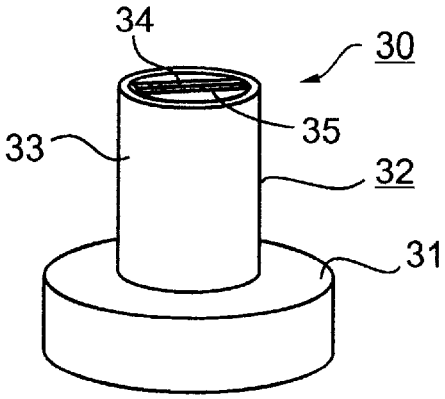
FIG. 19 illustrates a pouring spout similar to the construction of FIGS. 9–11, but embodied in a cap to be applied to a conventional pouring spout in a container, such as the above-described gable-type carton used for milk products.

FIG. 19 illustrates the pouring spout incorporated in an attachment, generally designated 30, having a collar 31 for attaching to a conventional pouring spout on a liquid container, and a pouring spout 32 constructed in accordance with the present invention. The illustrated pouring spout is of the construction which includes an outer rigid or semi-rigid tube 33 and two pliable plastic sheets 34, 35, extending transversely across the interior of tube 33. As described above, the two pliable plastic sheets 34, 35, should not be secured to the tube 33 along one or both of the longitudinal edges of the two plastic sheets to permit them to be self-opening when dispensing liquid, and self-closing (self-sealing) when not dispensing liquid.

Collar 31 may be attached in any suitable manner, such as by a press-fit or by threads, to an existing plastic pouring spout, e.g., of the type included in gable-type or brick-type milk containers, in lieu of the cap normally provided on such a container. This would enable the container to be used to dispense liquid whenever desired, and to be self-sealing when liquid is not being dispensed, as described above.

While pouring spout 32 illustrated in FIG. 17 is of the construction described above with respect to FIGS. 9–11, it will be appreciated it could be of any of the other constructions described above.

Figure 20:
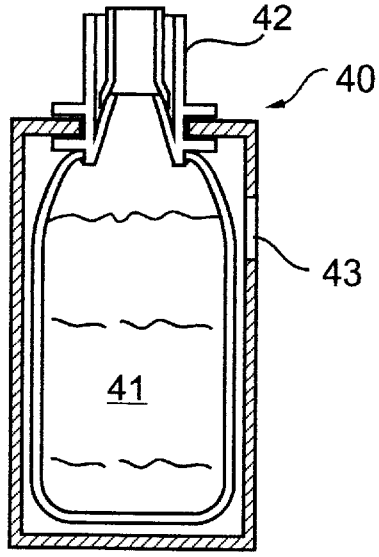
FIG. 20 illustrates another container construction including a pouring spout in accordance with the present invention.

FIG. 20 illustrates a container, therein generally designated 40, of a rigid or semi-rigid construction, including a liquid compartment 41 which may be of the plastic bag type, and a pouring spout 42 of any of the constructions described above. In this case, the container 40 is formed with an air inlet 43 to permit air to enter as the plastic liquid compartment 41 collapses with the dispensing of liquid therefrom via the pouring spout 42. Such a construction thereby permits substantially all the contents of the liquid compartment 41 to be dispensed.

Figure 21:
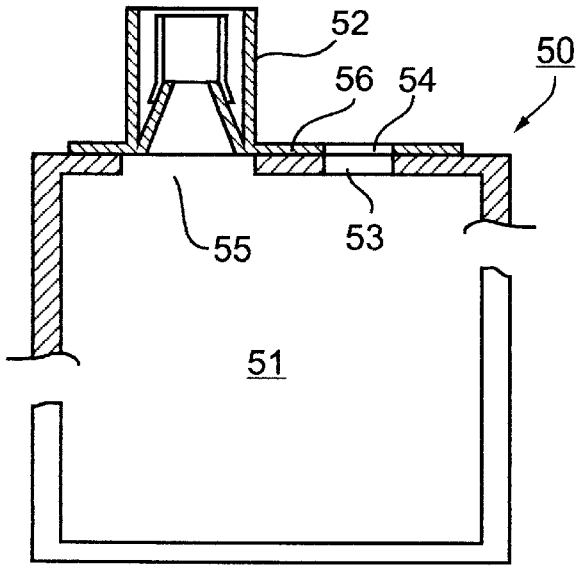
FIG. 21 is a fragmentary view illustrating a further container constructed with a pouring spout in accordance with the present invention.
Figure 22:
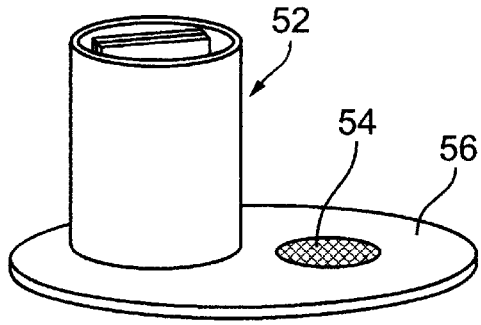
FIG. 22 illustrates the top wall of the container of FIG. 21 carrying the pouring spout as well as a filtered inlet into the container to permit the complete contents of the container to be dispensed.

FIGS. 21–22 illustrate another container, therein generally designated 50, also including a liquid compartment 51 of rigid or stiff plastic material, and a pouring spout 52 of any of the foregoing constructions to enable liquid to be dispensed from compartment 51 in a self-opening and self-sealing manner as described above. In this construction, however, the container 50 is provided with an air opening 53 covered by a suitable filter 54 that restricts ingress of contaminants to enable the complete contents of the liquid compartment 51 to be dispensed via the pouring spout 52.

Container 50 may be constructed of a rigid or semi-rigid plastic material and formed with opening 53 for the air inlet, and with opening 55 for the pouring spout 52. The pouring spout 52 and the filter 54 may be carried by a mounting plate 56 and attached to the upper end of container 50 such that the pouring spout 52 overlies the container opening 55, and the filter 54 overlies the air inlet opening 53.

Figure 23:
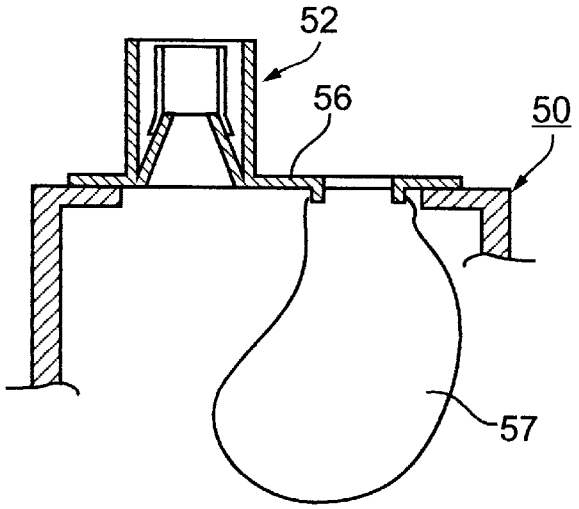
FIG. 23 illustrates another container constructed to include a pouring spout in accordance with the present invention and also to permit the complete contents of the container to be dispensed.
Figure 24:
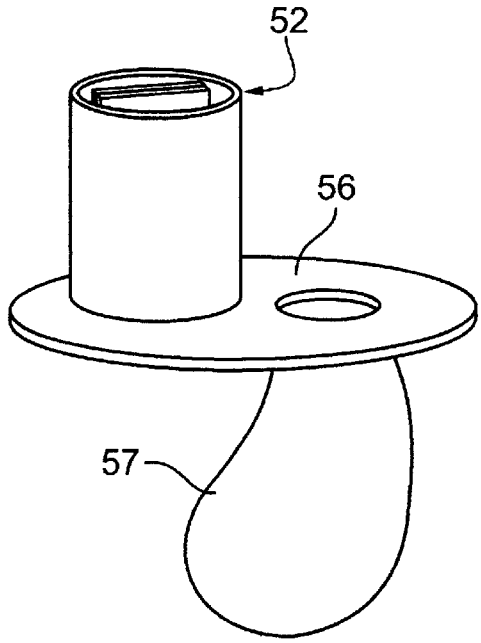
FIG. 24 illustrates the portion of the container of FIG. 23 including the pouring spout and also the means permitting the complete contents of the container to be dispensed.

FIGS. 23 and 24 illustrate a container similar to that illustrated in FIGS. 21 and 22, and therefore corresponding parts are identified with the same reference numerals to facilitate understanding. In the construction of FIGS. 23 and 24, however, the mounting plate 56 mounting the pouring spout 52 carries a balloon, shown at 57, instead of the filter 54. Balloon 57 is insertable via the air inlet opening 53 into the container 50. Thus, the construction illustrated in FIGS. 23 and 24 also permits substantially the complete contents of the container to be dispensed, but its balloon 57 isolates the inletted air from the contents of the container, thereby eliminating the need for the filter 54.

Figure 25:
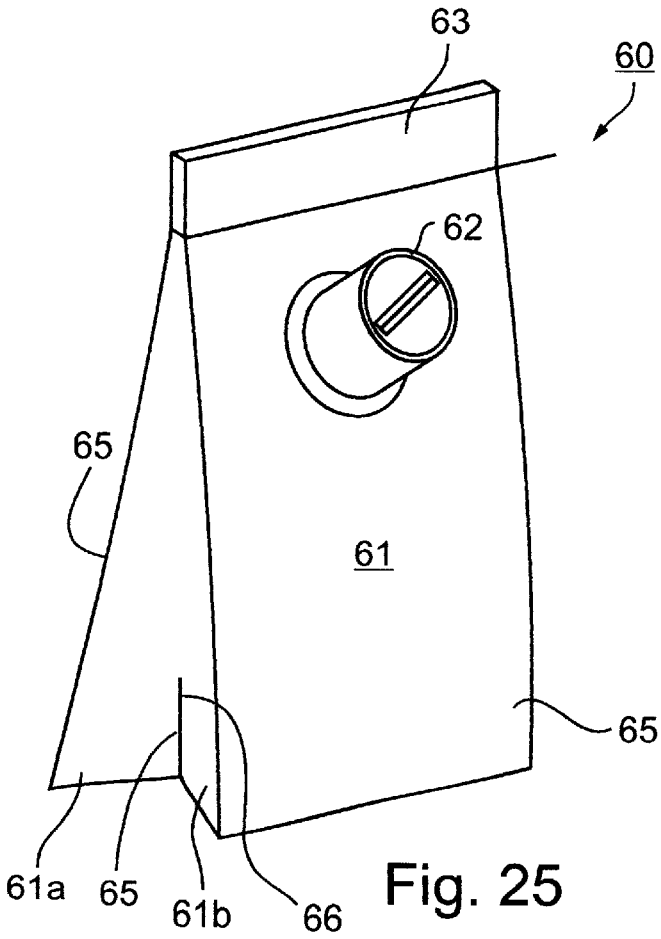
FIG. 25 illustrates another container constructed with a pouring spout in accordance with the present invention, the container being in the form of a foldable liquid compartment permitting the complete liquid contents of the container to be dispensed.

FIG. 25 illustrates another container, generally designated 60, also including a liquid compartment 61 and a pouring spout 62. The pouring spout 62 may be of any of the above described constructions. However, the liquid compartment 61 is of a folded construction, to permit the container to be collapsed in order to dispense substantially its complete contents.

As shown in FIG. 25, the liquid compartment section 61 is of a tapered construction, having a narrow top portion 63 and a wide bottom portion 64. The opposed side walls 65 are formed with fold lines 66 extending from the bottom portion to the top portion, to thereby provide two foldable compartment sections 61*a*, 61*b*. When the container is completely full, the fold lines 66 are open, thereby enabling compartment 61 to contain a maximum volume of liquid; and as the liquid is dispensed via the pouring spout 62, the two sections 61*a*, 61*b* of the liquid compartment 61 are moved towards each other via fold line 66 to decrease the volume of the container, and thereby to enable substantially the complete contents of the container to be dispensed.

Figure 26:
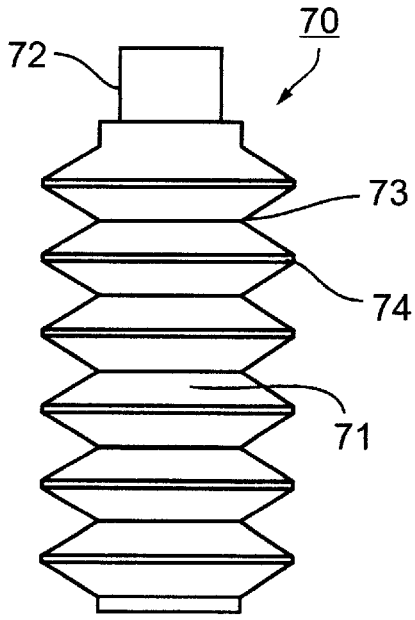
FIG. 26 illustrates a container similar to that of FIG. 25 but of a bellows construction to permit the complete contents of the container to be dispensed.

FIG. 26 illustrates a collapsible type container, therein generally designated 70, also including a compartment 71 for the liquid contents, and a pouring spout 72 to permit dispensing the liquid contents. Pouring spout 72 may be of any of the above-described constructions. The liquid compartment 71, however, is of a bellows construction, formed with a plurality of transversely-extending fold lines 73, 74, permitting the compartment to be collapsed as liquid contents are dispensed via the pouring spout 72.

Figure 27:
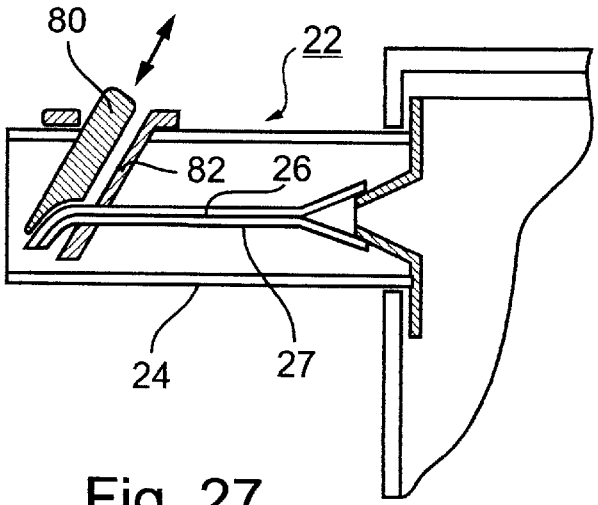
FIG. 27 illustrates the provision of a manually-movable pressing member for positively pressing the pouring spout to its closed condition to better assure its complete closure when the liquid is not to be dispensed.

FIG. 27 illustrates a pouring spout generally similar to that shown at 22 in FIGS. 9–11, and therefore the same reference numerals are used to identify corresponding parts to facilitate understanding. The pouring spout illustrated in FIG. 27, however, includes a manually-movable pressing member 80, movable in a guide 82, to press closed the outer ends of the two pliable plastic sheets 26, 27, and thereby to positively close the pouring spout defined by the two sheets, as well as to squeeze out any liquid between the two sheets. Other types of pressing members can be envisaged including semi-automatic and automatic pressing members. The pressing member preferably also serves to flush excess liquid from the spout, thus preventing the accumulation of liquid therein which is exposed to air and might be dispensed during the next time liquid is poured through the spout.

Figure 28:
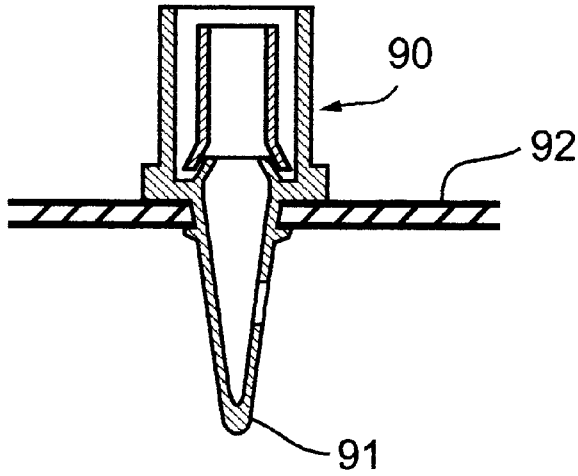
FIG. 28 illustrates the concept of constructing the pouring spout with a piercing element for attachment to a container to facilitate dispensing the liquid contents of the container.

FIG. 28 illustrates a variation wherein the pouring spout is attachable by a user to a liquid container by piercing the liquid container whenever it is desired to dispense contents from the liquid container. Thus, the pouring spout, therein generally designated 90, may be of any of the above-described constructions, such as that described in FIGS. 9–11 or that described in FIG. 19. It includes a piercing element 91 which is maintained sterile prior to use enabling the pouring spout to be attached to the liquid container 92, e.g., of a plastic or cardboard construction, by merely forcing the piercing element 91 through a wall of the container whenever it is desired to dispense the liquid contents, (e.g. milk, a beverage, etc.). Thus, the container 92 could be handled in a conventional manner, and whenever it is desired to dispense contents from it, the pouring spout 90 would be applied by forcing its piercing element 91 through a wall of the container. The contents of the container need not be completely consumed at one time, since the self-sealing feature of the pouring spout will substantially seal the interior of the container and thereby enable the container contents to be preserved for a relatively long period with or without refrigerated storage.

Figure 29:
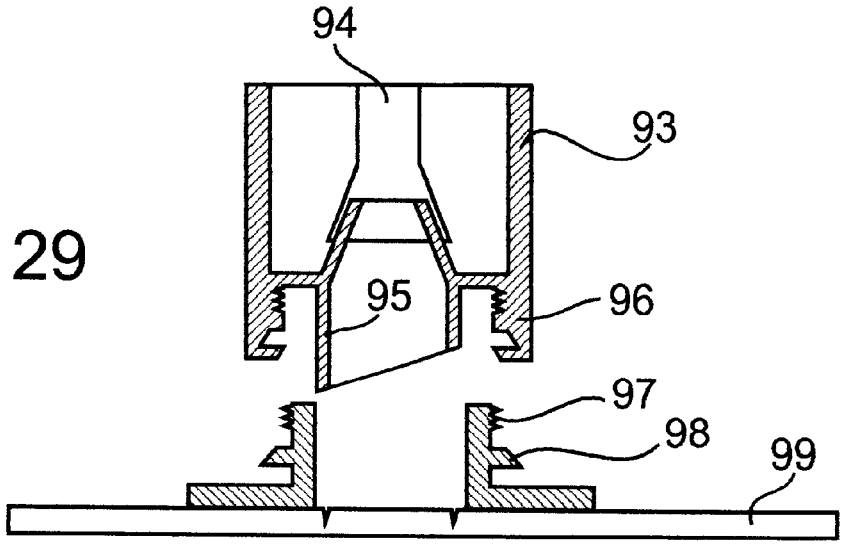
FIG. 29 is a sectional view illustrating one construction of pouring spout with piercing element that may be used for attachment to a container.
Figure 30:
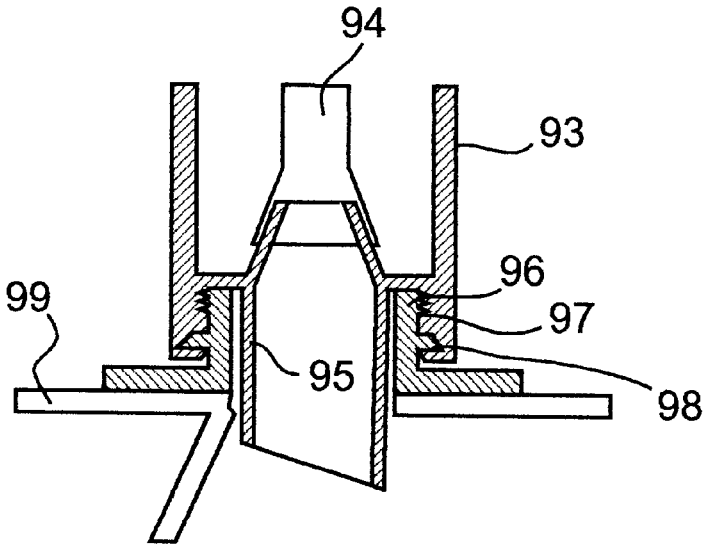
FIG. 30 illustrates the pouring spout of FIG. 29 after attachment to the container.

FIGS. 29 and 30 more particularly illustrate an example of a construction of such a self-sealing pouring spout for attachment to a liquid container whenever it is desired to dispense contents from it. The pouring spout illustrated in FIGS. 29 and 30 is of a similar construction as described above with respect to FIGS. 10 and 11, in that it includes an outer tube 93 enclosing two pliable sheets, shown at 94, defining the dispensing passageway between them (corresponding to sheets 26, 27, FIG. 10), which passageway automatically opens when dispensing the liquid, and self-closes when not dispensing the liquid. The pouring spout illustrated in FIG. 29 further includes a cylindrical piercing member 95 enclosed by an attaching section 96 threadedly received on an attaching section 97 of a member 98 secured to the container 99. Thus, the pouring spout may be attached to the container initially under sterile conditions by partially threading section 96 of the pouring spout onto section 97 of the container to cause the piercing cylinder 95 to pierce the outer wall of the container 99, as shown in FIG. 30. Complete threading of section 96 and piercing of a ply covering the container from the inside thereof, so as to form fluid communication between the spout and the container is accomplished just prior to use. As a result, the original shelf life of the product is maintainable.

Figure 31:
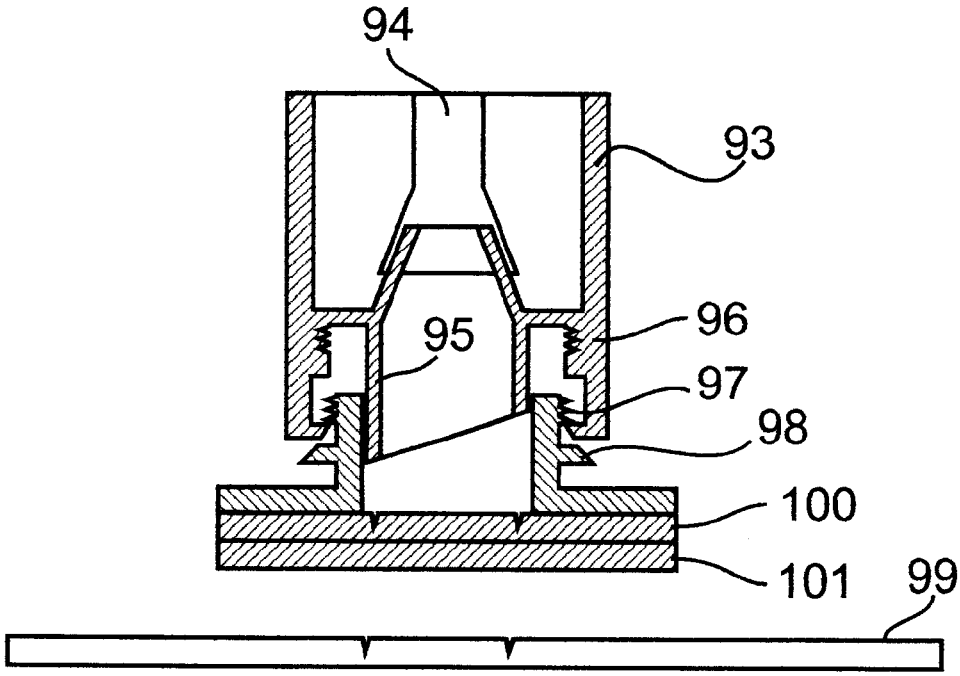
FIG. 31 illustrates a pouring spout similar to that of FIGS. 29 and 30 but one that may be manually attached to a standard container whenever desired to pour out its contents.

FIG. 31 illustrates a construction similar to that of FIGS. 29 and 30, and therefore corresponding parts are identified by the same reference numerals to facilitate understanding. In the construction illustrated in FIG. 31, however, member 98 is not secured to the container 99, as in FIGS. 29, 30, but rather is threaded on one side to the attaching section 96, and carries a pressure-sensitive adhesive layer 100 on the opposite side, which adhesive layer is normally protected by a peelable film 101. Thus, whenever it is desired to attach the illustrated pouring spout to a container 99, peelable film 101 is removed to expose the adhesive layer 100, and the pouring spout is pressed against the container 99 to bring the adhesive layer 100 into contact with it, and then the outer tube 93 is rotated to force its cylindrical piercing member 95 through the container wall 99.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A pouring spout for a liquid container comprising a non-resilient, pliable plastic sheet defining one side of the pouring spout and movable towards and away from an opposite side of the pouring spout to close and open the pouring spout for dispensing liquid therethrough; said non-resilient, pliable plastic sheet being dimensioned such that when liquid is to be dispensed, the non-resilient, pliable plastic sheet is freely movable away from said opposite side by the liquid to permit the liquid to be dispensed, and when liquid is not being dispensed through the pouring spout, the non-resilient, pliable plastic sheet moves towards and into contact with said opposite side and adheres to said opposite side solely by surface tension of the liquid to produce a liquid dependent self-sealing action with respect to said pouring spout.

2. The pouring spout according to claim 1, wherein said opposite side of the pouring spout is also a non-resilient pliable plastic sheet freely movable towards and away from the pliable plastic sheet at said one side of the pouring spout.

3. The pouring spout according to claim 2, wherein the pouring spout further includes a tube enclosing said two pliable plastic sheets and open at its outer end, said two pliable plastic sheets extending transversely across the interior of said tube and having outer edges bonded to each other, at least one of the said outer edges being free to move with respect to said tube such that the intermediate portions of the two pliable plastic sheets are movable towards and away from each other to close and open the pouring spout in order to permit dispensing liquid therethrough.

4. The pouring spout according to claim 1, wherein said opposite side of the pouring spout is constituted of a surface of a non-pliable member of a concave configuration engageable by said pliable plastic sheet and self-sealing with respect thereto when said pliable plastic sheet is movable into contact therewith.

5. The pouring spout according to claim 1, wherein the pouring spout is in the form of a cap removably attachable to a liquid container.

6. The pouring spout according to claim 1, wherein the pouring spout is initially fixed to a liquid container in alignment with an opening therein.

7. The pouring spout according to claim 1, wherein the pouring spout includes a piercing member for attachment to a liquid container.

8. The pouring spout according to claim 7, wherein said piercing member is enclosed within a tube and is manually depressible to project through the tube and to pierce the container when applied thereto.

9. The pouring spout according to claim 8, wherein said tube enclosing the piercing member is closed by an adhesive strip for applying the pouring spout to the container, which adhesive strip is also pierced by the piercing member when manually depressed.

10. A liquid container including a compartment for a liquid, and a pouring spout;

said pouring spout comprising a non-resilient pliable plastic sheet defining one side of the pouring spout and movable towards and away from the opposite side of the pouring spout to close and open the pouring spout for dispensing liquid therethrough;

said non-resilient pliable plastic sheet being dimensioned such that when liquid is to be dispensed, the non-resilient pliable plastic sheet is freely movable away from said opposite side by the liquid to permit the liquid to be dispensed, and when liquid is not being dispensed through the pouring spout, the pliable plastic sheet moves towards and into contact with said opposite side and adheres to said opposite side solely by surface tension of the liquid to produce a liquid dependent self-sealing action with respect to said pouring spout.

11. The liquid container according to claim 10, wherein said opposite side of the pouring spout is also a non-resilient pliable plastic sheet freely movable towards and away from the pliable plastic sheet at said one side of the pouring spout.

12. The liquid container according to claim 11, wherein said liquid compartment is also of pliable plastic sheets which are integrally formed with said pliable plastic sheets of the pouring spout.

13. The liquid container according to claim 12, wherein said pouring spout is integrally formed in a corner of the container.

14. The liquid container according to claim 10, wherein said pouring spout is initially closed at its outer end and is openable by severing its outer end.

15. The liquid container according to claim 10, wherein the pouring spout further includes a tube enclosing said two pliable plastic sheets and open at its outer end, said two pliable plastic sheets extending transversely across the interior of said tube and having outer edges bonded to each other, at least one of said outer edges being free to move with respect to said tube such that the intermediate portions of the two pliable plastic sheets are movable towards and away from each other to close and open the pouring spout in order to permit dispensing liquid therethrough.

16. The liquid container according to claim 10, wherein said opposite side of the pouring spout is constituted of a non-pliable member of a concave configuration engageable by said pliable plastic sheet and self-sealing with respect thereto when said pliable plastic sheet is movable into contact therewith.

17. The liquid container according to claim 10, wherein said pouring spout is fixed to said liquid container in alignment with an opening in its liquid compartment.

18. The liquid container according to claim 17, wherein the container is of a rigid construction and includes a filtered air inlet into its liquid compartment to permit dispensing substantially the complete liquid contents of the container through said pouring spout.

19. The liquid container according to claim 17, wherein said container is of a construction permitting the internal volume of its liquid compartment to be reduced as liquid is dispensed therefrom.

20. The liquid container according to claim 19, wherein the liquid container is of a rigid construction and includes an inflatable balloon within its liquid compartment connected to an air inlet to permit dispensing substantially the complete liquid contents of the liquid compartment through said pouring spout.

21. The liquid container according to claim 19, wherein the container is of a collapsible construction permitting the internal volume of its liquid compartment to be reduced as liquid is dispensed therefrom.

22. The liquid container according to claim 21, wherein the container is of a foldable construction permitting the internal volume of its liquid compartment to be reduced as liquid is dispensed therefrom.

23. The liquid container according to claim 21, wherein the container is of bellows construction permitting the internal volume of its liquid compartment to be reduced as liquid is dispensed therefrom.

24. The liquid container according to claim 10, wherein said container includes a manually-movable pressing member for pressing said pliable plastic sheet of the pouring spout to its closed position in contact with said opposite surface.

* * * * *